United States Patent [19]

Wilcox et al.

[11] 3,970,768

[45] July 20, 1976

[54] GRID ELECTRODES

[75] Inventors: David Mark Wilcox; William David Richard Rivers, both of Chelmsford, England

[73] Assignee: English Electric Valve Company Limited, Chelmsford, England

[22] Filed: July 30, 1975

[21] Appl. No.: 600,499

[30] Foreign Application Priority Data

Aug. 3, 1974 United Kingdom ..... 34307/74

[52] U.S. Cl. ..... 427/50; 427/122; 427/249

[51] Int. Cl.[2] ..... H01J 1/48; C23C 11/00

[58] Field of Search ..... 427/50, 52, 122, 249

[56] References Cited

UNITED STATES PATENTS

| | | | |
|---|---|---|---|
| 2,764,510 | 9/1956 | Ziegler | 427/122 X |
| 3,107,180 | 10/1963 | Diefendorf | 427/122 |
| 3,138,434 | 6/1964 | Diefendorf | 427/50 X |
| 3,187,502 | 6/1965 | Stover | 427/122 X |
| 3,379,555 | 4/1968 | Hough | 427/249 X |
| 3,399,969 | 9/1968 | Bokros et al. | 427/122 X |

*Primary Examiner*—James R. Hoffman

*Attorney, Agent, or Firm*—Baldwin, Wight & Brown

[57] ABSTRACT

A method of making a pyrolytic graphite grid electrode for a high power transmitting tube includes the steps of holding a metallic grid electrode core between two copper blocks, heating the core to 1750°C by passing an electric current through it and passing a carbonaceous gas over the heated core so that graphite is deposited thereon.

Because the graphite thickness is reduced towards the copper blocks supporting the core, where the grid is to be used in a high voltage tube annular shields are provided around the supported ends of the grid.

6 Claims, 2 Drawing Figures

GRID ELECTRODES

Figure 1:
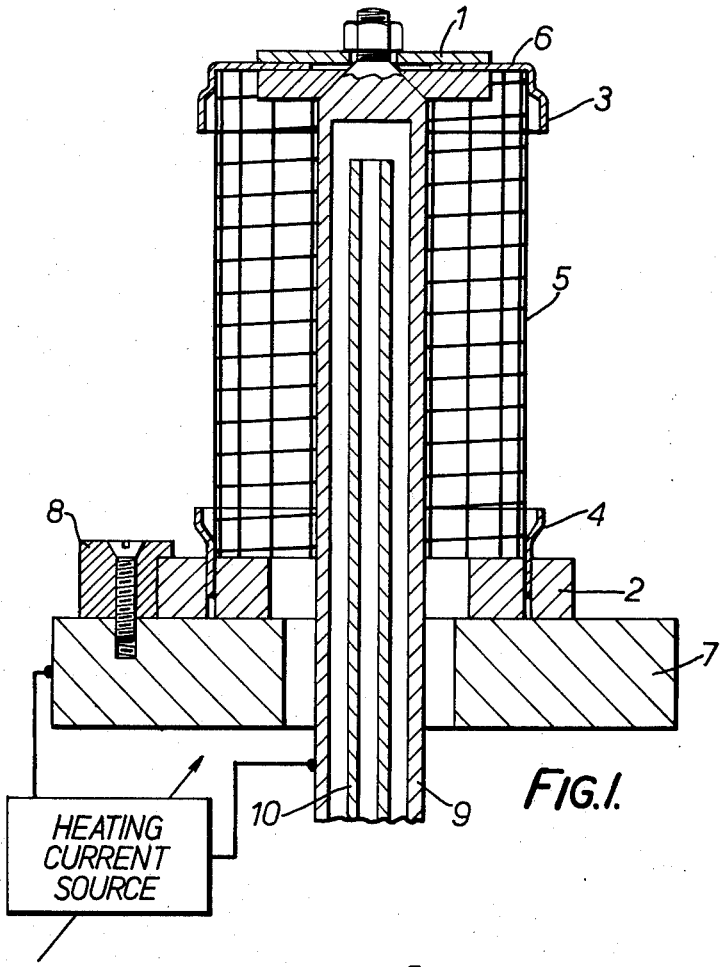

This invention relates to pyrolytic graphite grids.

Pyrolytic graphite is a form of molecularly ordered carbon which is produced by vapour deposition resulting from the decomposition of a hot carbonaceous gas. Although the material is often referred to as pyrolytic graphite, it is not a true graphite in the crystallographic sense. The properties of pyrolytic graphite are described in the article "Pyrolytic Graphite" by W. H. Smith and D. H. Leeds published in Modern Material, Volume 7 at page 139 et. seq., Academic Press Inc. New York and London 1970. The special properties of pyrolytic graphite render it particularly suitable for use as a grid electrode in, for example, high power transmitting tubes. The difficulty of working pyrolytic graphite is well known. It is a brittle and highly anisotropic substance, although the technique of working blanks of pyrolytic graphite using shot abrasion is successful for certain applications. The present invention is concerned with grid electrodes in which a coating of pyrolytic graphite surrounds a metallic grid core. Hitherto such articles have been made by preheating a relatively large volume of carbonaceous gas from which is deposited the pyrolytic graphite onto a suitable substrate, in this case a metallic grid. Pyrolytic graphite is deposited not only onto the substrate, but also indiscriminately onto the surroundings of the chamber in which the substrate is usually placed.

The present invention seeks to provide an improved way of producing a pyrolytic graphite grid electrode.

According to this invention a method of making a pyrolytic graphite grid electrode comprises holding a metallic grid electrode core between relatively massive bodies which are of good thermal conductivity, passing a carbonaceous gas over said metallic grid electrode core whilst the grid electrode core is held at the temperature required for the deposition of pyrolytic graphite by passing an electric current through it.

The temperature can be readily adjusted by controlling the amount of electric current passing. Pyrolytic graphite is deposited only onto those parts of the grid electrode core between the relatively massive bodies, since the relatively massive bodies themselves do not reach the temperature necessary to produce a deposit thereupon of pyrolytic graphite. The layer of carbonaceous gas in contact with the hot grid electrode core is decomposed, and pyrolytic graphite is therefore deposited only in the required localised regions. This affords an economy of heating energy, and prevents the indiscriminate deposition of the pyrolytic graphite onto the surroundings where it is not required, and where its presence could prove disadvantageous.

In view of the localised cooling effect on the regions of the grid electrode core adjacent to the relatively massive bodies, the deposition is much reduced here, and tapers away to virtually nothing at the points of contact between the relatively massive bodies and the grid electrode core. There is thus a transition between regions of the grid electrode core which are coated with pyrolytic graphite and regions which are not.

Preferably the metallic grid electrode core is an open wire mesh defining a hollow cylinder, at each end of which is present a relatively massive body whilst the metallic grid electrode core is heated.

Preferably again one of the relatively massive bodies is located on a support passing through the hollow cylinder.

Preferably yet again the support is water cooled.

In use, the aforementioned transition may give rise to electrical breakdown due to surface imperfections which result from the extreme thinness of the coating. This is particularly so where the grid electrode is to be operated at high voltages in vacuum.

Preferably the transition is provided with an electrically conductive shield, which in the case of a cylindrical grid electrode, extends completely round the outer surface of the cylinder.

Figure 2:
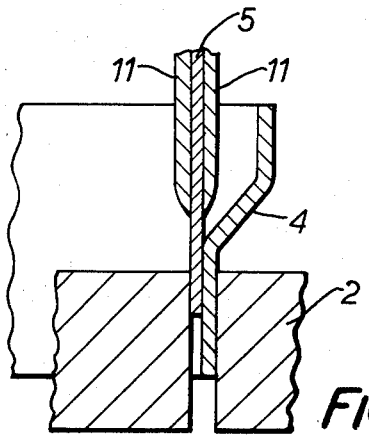

The invention is further described, by way of example, with reference to the accompanying drawings in which, FIG. 1 illustrates a sectional view of a grid electrode in accordance with the present invention and, FIG. 2 shows a detail thereof.

Referring to FIG. 1 a grid electrode 5 is supported between a pair of relatively massive copper bodies 1 and 2. The grid electrode 5 consists of a cylindrical mesh envelope which is open at its lower end (as drawn) and which is partially closed at its upper end (as drawn) by an end cap 6. The grid electrode 5 is composed of parallel vertical metallic wires which are held together in place by a shallow wire helix as shown. The body 2 is secured to a base plate 7 via a clamp 8. The body 1 is attached to a support 9, which is hollow and provided with an inner open-ended tube 10 through which a fluid coolant, such as water, can be passed.

An annular shield 3 and 4 is provided at each end of the grid electrode 5. They are composed of an electrically conductive material and serve to shield the transition region which occurs at each end of the grid electrode 5 when pyrolytic graphite is deposited onto it.

As so far described the grid electrode 5 consists merely of a metallic wire grid core. In order to build up a coating of pyrolytic graphite onto it, an electric current is passed through it to heat it. This is accomplished by a heating current source 20 maintaining a potential difference between the base plate 7, and the support 9. The heating current source 20, which is adjustable, may be either d.c. or a.c. and serves to raise the grid electrode core to a temperature of between 1600°C and 2600°C, but preferably a temperature of about 1750°C. Of course the temperature of the ends of the grid electrode 5 adjacent to the bodies 1 and 2 will be much less than this owing to the localised cooling effect.

Only the vertical wires of the grid electrode core conduct a significant amount of the electric current, since the individual helix turns are at very nearly equipotentials. Thus only the vertical wires are directly heated, and the helix is heated by heat conduction from the verticals. The helix will be more uniformly heated (resulting in a more even coating of pyrolytic graphite) if the verticals are closely spaced.

Alternatively a diamond mesh grid can be used where the helices which constitute the mesh are at equal angles but in opposite screw directions so that they heat up uniformly.

Whichever form of grid is used provision must be made to accommodate movement of the end contacts which occurs due to expansion of the grid on heating.

A carbonaceous gas, such as acetylene is passed over the hot grid electrode core and is thereby caused to heat up and decompose, causing pyrolytic graphite to be deposited in the form of a molecularly ordered coating onto the surface of the grid electrode core.

FIG. 2 illustrates diagrammatically this coating and the transition region that occurs where the thickness of the coating 11 covering the grid electrode core 5 tapers away to nothing at points adjacent to the body 2. In this transition region, the quality of the coating is poor as it is deposited at too cool a temperature, and instead of a smooth exterior surface, a rough and pitted surface is produced.

Where the grid electrode so produced is to be used at high voltage in, say, a transmitting tube, the presence of such roughness could give rise to electrical breakdown in vacuum. To reduce this difficulty the grid electrode is provided with the annular shields 3 and 4, which are fixed securely to its ends as shown. Each annular shield is provided with a lip portion 12 which is spaced from the surface of the grid electrode 5 to provide electrical shielding therefor.

Because these annular shields 3 and 4 are closely adjacent to the bodies 1 and 2 during the deposition step, virtually no pyrolytic graphite is deposited on them as their temperature is held to a reasonably low value.

It will be appreciated that by heating the grid electrode core by the expedient of passing electric current directly through it, it can be arranged that the transition region between coated and uncoated electrodes lies within that portion which in normal operation is shielded by the annular shields 3 and 4 from the effects of high voltage breakdown.

We claim:

1. A method of making a pyrolytic graphite grid electrode comprising the steps of holding a metallic grid electrode core between relatively massive bodies which are of good thermal conductivity, passing a carbonaceous gas over said metallic grid electrode core whilst the grid electrode core is held at the temperature required for the deposition of pyrolytic graphite by passing an electric current through it.

2. A method as claimed in claim 1 in which the temperature is adjusted by controlling the amount of electric current passing.

3. A method as claimed in claim 1 wherein the metallic grid electrode core is an open wire mesh defining a hollow cylinder, at each end of which is present a relatively massive body whilst the metallic grid electrode core is heated.

4. A method as claimed in claim 3 wherein one of the relatively massive bodies is located on a support passing through the hollow cylinder.

5. A method as claimed in claim 4 wherein the support is water cooled.

6. A method as claimed in claim 1 in which these regions of the metallic grid electrode adjacent said relatively massive bodies are provided with electrically conductive shields to inhibit voltage breakdown at those regions in normal use of the electrode.

* * * * *